US009027715B2

(12) United States Patent
Bloch et al.

(10) Patent No.: US 9,027,715 B2
(45) Date of Patent: May 12, 2015

(54) FIRE SERVICE ELEVATOR

(75) Inventors: Hanspeter Bloch, Buchrain (CH); Georg Stenvers, Lucerne (CH)

(73) Assignee: Inventio AG, Hergiswil (CH)

( * ) Notice: Subject to any disclaimer, the term of this patent is extended or adjusted under 35 U.S.C. 154(b) by 225 days.

(21) Appl. No.: 13/197,951

(22) Filed: Aug. 4, 2011

(65) Prior Publication Data

US 2012/0031712 A1 Feb. 9, 2012

(30) Foreign Application Priority Data

Aug. 5, 2010 (EP) ..... 10172051

(51) Int. Cl.

| | |
|---|---|
| ***B66B 11/02*** | (2006.01) |
| ***B66B 7/00*** | (2006.01) |
| ***E04D 13/00*** | (2006.01) |
| ***B66B 5/02*** | (2006.01) |

(52) U.S. Cl.

CPC ..... *B66B 11/0226* (2013.01); *B66B 5/024* (2013.01)

(58) Field of Classification Search

CPC ..... B66B 11/0226; B66B 11/0253; E04D 13/076; E04D 13/063

USPC ..... 187/401, 414; 52/404.5, 406.2, 406.3, 52/407.3, 406.1, 198, 19, 11, 169.14

See application file for complete search history.

(56) References Cited

U.S. PATENT DOCUMENTS

| | | | | |
|---|---|---|---|---|
| 4,112,632 | A * | 9/1978 | Simpson | 52/11 |
| 4,559,263 | A * | 12/1985 | Roodvoets | 428/312.4 |
| 4,804,578 | A * | 2/1989 | Crookston | 428/304.4 |
| 5,207,033 | A * | 5/1993 | Sells | 52/14 |
| 5,901,518 | A * | 5/1999 | Harkins | 52/404.3 |
| 7,393,273 | B2 * | 7/2008 | Ehrman et al. | 454/365 |
| 7,523,809 | B2 * | 4/2009 | Monzon-Simon et al. | 187/401 |
| 7,950,188 | B1 * | 5/2011 | Galbraith et al. | 52/12 |
| 8,015,769 | B2 * | 9/2011 | Crostic et al. | 52/407.4 |
| 2008/0190711 | A1 * | 8/2008 | Patrick et al. | 187/401 |
| 2009/0188172 | A1 * | 7/2009 | DuCharme et al. | 52/11 |

FOREIGN PATENT DOCUMENTS

| | | | |
|---|---|---|---|
| JP | 7061734 | A | 3/1995 |
| JP | 2004161404 | A | 6/2004 |
| JP | 2005060008 | A | 3/2005 |
| JP | 2009190843 | A | 8/2009 |
| WO | 9822381 | A1 | 5/1998 |

* cited by examiner

*Primary Examiner* — William E Dondero
*Assistant Examiner* — Minh Truong
(74) *Attorney, Agent, or Firm* — Fraser Clemens Martin & Miller LLC; William J. Clemens

(57) ABSTRACT

A fire service elevator with an elevator cage includes a cage roof, wherein the elevator cage is at least partly supported and driven by at least one support means. The elevator cage has on the cage roof a region vulnerable to spray water, and this region vulnerable to spray water is covered by an element having a surface structure of such a kind that extinguishing water falling on the element in the event of fire is substantially prevented from spraying in the direction of the at least one support means.

20 Claims, 4 Drawing Sheets

FIRE SERVICE ELEVATOR

CROSS-REFERENCE TO RELATED APPLICATION

This application claims priority to European Patent Application No. 10172051.4, filed Aug. 5, 2010, which is incorporated herein by reference.

FIELD

The present disclosure relates to the design of an elevator cage for use with an extinguishing water discharge system.

BACKGROUND

Modern elevator installations generally try to guarantee reliable operation even in the event of fire. On the one hand, the evacuation of persons and/or vulnerable material from the stories affected by the fire should generally be guaranteed, and on the other hand, a functionally capable elevator should be available for the transport of fire service personnel and their extinguishing material. In either case the use of extinguishing water should not have the consequence that the elevator installation or the fire service elevator no longer functions. This applies not only to the use of a sprinkler installation on a story, but also to the use of extinguishing water by the fire service.

This generally means that electrical components of the elevator installation should remain dry. In addition, it generally means that a support means on a drive pulley is still driven as desired. Extinguishing water can in that case have a negative influence on the traction of the support means on the drive pulley. On the one hand extinguishing water can directly reduce the coefficients of friction between the drive pulley and the support means and on the other hand lubricant present in the extinguishing water can additionally negatively influence the traction between support means and drive pulley. A support means wetted by extinguishing water can thus lead to reduction in traction or even to complete loss of traction. In the case of, in particular, a substantial difference between the weight of the elevator cage and of a counterweight an uncontrolled travel of the elevator cage can then arise, which has to be stopped by safety brakes. Faultless functioning of the safety brake or the braking retardation of the brake shoes thereof on guide rails can, however, also not be guaranteed if the brake shoes of the guide rails are moistened by extinguishing water.

The use of belt-like support means instead of steel cables can have the problem of a heightened loss of traction between support means and drive pulley. The synthetic material surfaces of belt-like drive means change their traction properties in the case of wetting by extinguishing water more strongly than steel-cable-like support means. This can make it necessary to conduct away or collect the extinguishing water in controlled manner. It can be necessary to prevent support means sections which co-operate with the drive pulley from being wetted by extinguishing water.

The extinguishing water normally penetrates into the elevator shaft by way of the shaft doors of the elevator shaft. In that case the extinguishing water flows on a story floor under the shaft doors through into the elevator shaft. International published specification WO 98/22381 A1 discloses an elevator installation with a drainage system at the shaft doors as well as mechanically positively inter-engaging flow barriers at each shaft door. It is attempted in this manner to keep the elevator shaft at the outset free of extinguishing water over its entire height. However, a possible disadvantage of this solution can be that each story has to be equipped, with a high cost outlay, with appropriate drainage pipes and the said flow barriers.

SUMMARY

At least some embodiments comprise a drain system not at the individual shaft doors, but at the elevator cage itself. This concept derives from the recognition that the extinguishing water in principle does not necessarily have to be kept away from the elevator shaft, but can also flow away in controlled or diversionary manner. It was observed that a principal cause of the support means becoming wet is the spraying or atomization of the extinguishing water when impinging on the roof of the elevator cage.

At least some embodiments relate to a fire service elevator with an elevator cage having a cage roof, wherein the elevator cage is at least partly supported and driven by at least one support means. The elevator cage has on the cage roof a region vulnerable to spray water, and this region vulnerable to spray water is covered by an element having a surface structure of such a kind that extinguishing water falling on the element in the event of fire is substantially prevented from spraying in the direction of the at least one support means.

The element with the above-mentioned properties is termed "spray-inhibiting element" in the following.

Fire service elevators are elevators which have special adaptations so that they can remain capable of use for longer time in the case of a fire. Such adaptations are, for example, electronic components protected from spray water, fire-resistant cage elements or a specific control mode for the case of fire. The spray-inhibiting element is equally such an adaptation. In this sense any elevator which is equipped with such a spray-inhibiting element is termed fire service elevator in the following.

The region vulnerable to spray water and covered by the spray-inhibiting element can be arranged at a side edge of the cage roof closest to the cage doors. Because the extinguishing water falls through slots under the shaft doors into the shaft it can be particularly important to equip with spray-inhibiting elements that region of the cage roof which faces towards the shaft doors.

It can be advantageous with respect to the proposed solution that adaptations or special constructional measures do not necessarily have to be undertaken at either the elevator itself or at the elevator shaft. The proposed spray-inhibiting element can, for example, also be retrofitted in existing elevator installations in simple mode and manner. In addition, this proposed solution is economic, because in a minimal variant it consists solely of the spray-inhibiting element.

A further possible advantage of the proposed solution is that elevator cages of different types can be retrofitted. The spray-inhibiting element can be arranged not only on flat or inclined cage roofs, but also on irregularly shaped cage roofs. This enables retrofitting of the extinguishing water diverting system according to almost all types of elevators. In at least some embodiments, the spray-inhibiting element can thus be understood as an additional component which can be arranged on existing intrinsically closed elevator cages.

The spray-inhibiting element can be arranged on a watertight surface. It can thereby be achieved that the extinguishing water can flow from the spray-inhibiting element over this watertight surface to edges of the cage roof and from there to the cage walls and/or to the cage doors. However, it can also be possible to arrange the spray-inhibiting element on a non-watertight surface so that the extinguishing water can flow from the spray-inhibiting element through the cage roof into the interior of the elevator cage.

In some embodiments, walls protruding beyond the spray-inhibiting element are arranged in prolongations of cage side walls. It can thereby be achieved that no extinguishing water can flow from the spray-inhibiting element over the cage side walls, but is guided over the cage back wall and/or the cage doors. Such walls can be advantageous particularly for elevator installations in which the support means are guided along the cage side walls. Such walls can be dimensioned in such a manner that they conduct the extinguishing water, which flows from the spray-inhibiting elements over the cage roof, in desired paths.

In further embodiments these walls are, however, dimensioned in such a manner that they even keep possible residual spray water away from the support means. Conversely, a spray-inhibiting element can be used for the purpose of reducing a necessary wall height of such walls which would be required without a spray-inhibiting element. High side walls can have the disadvantage that the cage hits earlier against a shaft ceiling, i.e. can be moved less high in a shaft, and that accessibility is impaired in the case of assembly operations from the cage roof, for example to a drive arranged laterally in the shaft head. Accordingly, it can be advantageous to keep such walls as low as possible. The necessary wall height can be decisively reduced by a spray-inhibiting element.

The spray-inhibiting element has a surface structure which substantially prevents extinguishing water, which falls onto the element in the case of a fire, from spraying in the direction of the support means. In some embodiments the spray-inhibiting element is constructed as porous material. The surface structure of porous material allows falling extinguishing water to penetrate at least partly into the porous material and prevents strong spraying away of extinguishing water. Foam materials, spongy materials or porous stones, for example, come into consideration as porous materials. In some cases, the porous material can have a low weight and is of fire-resistant construction.

In an alternative embodiment the spray-inhibiting element is constructed as a grate-like element. This grate-like element has longitudinal elements which are arranged in such a manner that they stand substantially perpendicularly to a plane of the cage doors. These longitudinal elements substantially prevent extinguishing water, which is falling down, from spraying in the direction of the support means. For that purpose the longitudinal elements can be so dimensioned and aligned that they effectively intercept extinguishing water sprayed from the cage roof in the direction of the support means. In addition to these longitudinal elements the grate-like element can also have transverse elements, which are connected with the longitudinal elements and arranged substantially perpendicularly thereto. In further embodiments these transverse elements have openings through which extinguishing water which has collected in the grate-like element can escape.

BRIEF DESCRIPTION OF THE DRAWINGS

The disclosed technologies are explained in more detail symbolically and by way of example with reference to the figures, in which.

DETAILED DESCRIPTION

Figure 1:
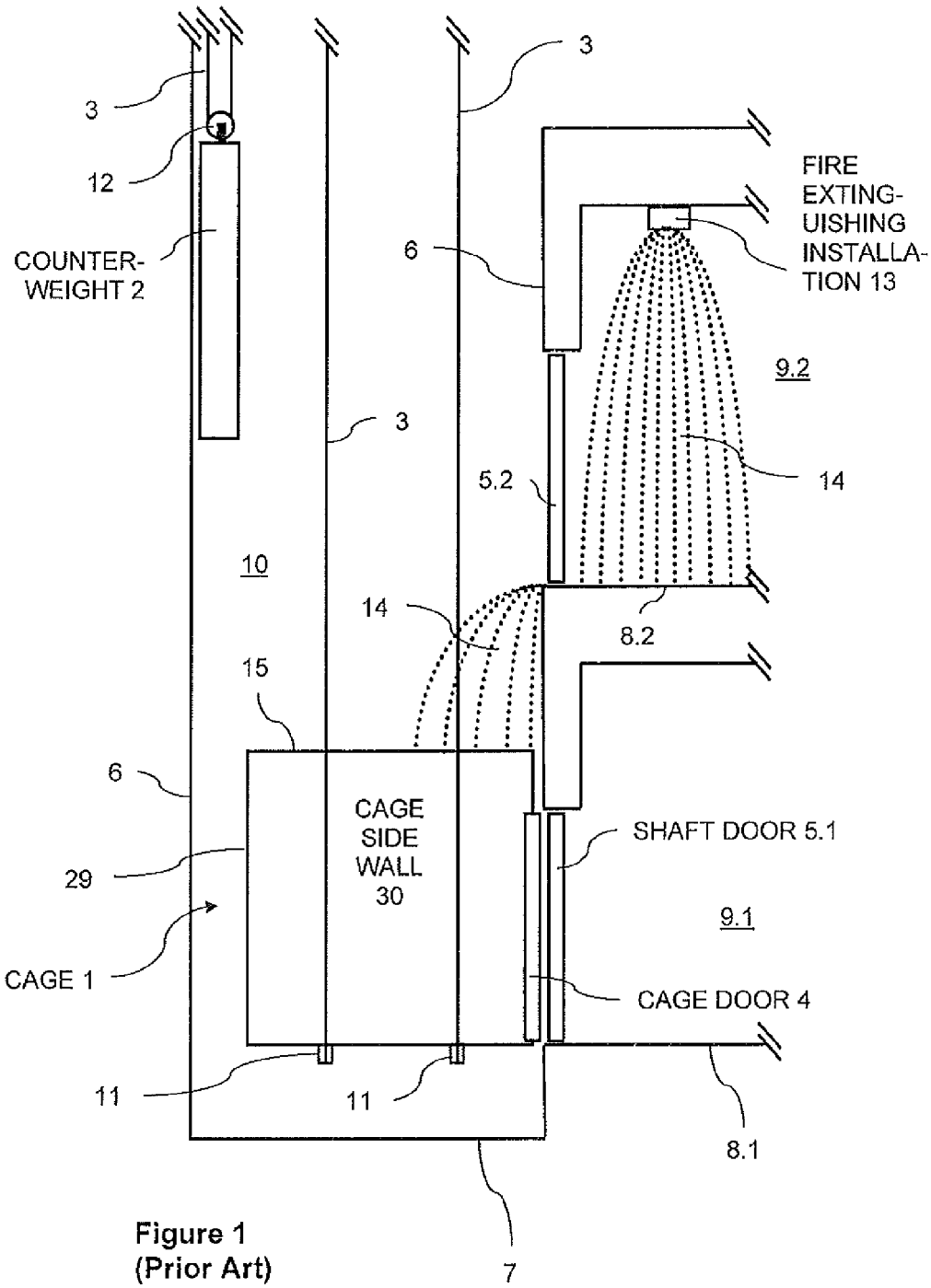
Figure 1 (Prior Art)
FIG. 1 shows a schematic illustration of an exemplifying elevator installation in a building with a fire extinguishing installation.

FIG. 1 shows an elevator installation such as is known from the prior art. A cage 1 and a counterweight 2 are arranged in an elevator shaft 10. In that case both the elevator cage 1 and the counterweight 2 are coupled with a support means 3. Through driving the support means 3 by a drive (not illustrated) the elevator cage and the counterweight can be moved vertically in the shaft 10. In the illustrated exemplifying embodiment both the elevator cage 1 and the counterweight 2 are suspended at support rollers 11, 12. The cage rollers 11 are in that case arranged below the cage 1 so that the cage 1 is underslung by the support means 3. By contrast thereto the counterweight support roller 12 is arranged above the counterweight 2 so that the counterweight 2 is suspended at the counterweight support roller 12. As a result of the underslinging of the elevator cage 1 the support means 3 is guided along cage side walls 30.

A shaft wall 6 has at the height of a story 9.1, 9.2 a respective opening which can be closed by a respective shaft door 5.1, 5.2. A fire extinguishing installation 13 is installed on the second lowermost story 9.2. The fire extinguishing installation 13 is arranged at a ceiling of the story 9.2 so that extinguishing water 14 can reach an as large as possible number of fire sites. The extinguishing water 14 collects on the story floor 8.2 and flows from there, at least partly, down through the shaft door 5.2 and into the elevator shaft 10. As illustrated in FIG. 1, the extinguishing water 14 flowing through the shaft door falls in the manner of a waterfall from above onto the elevator cage 1. From the elevator cage 1 the extinguishing water flows further down until it collects at the shaft base 7 (not illustrated).

The distribution of the extinguishing water 14 in the elevator shaft 10 can be dependent on inter alia the following factors: For entry of the extinguishing water into the elevator shaft 10 initially the amount of extinguishing water and also the size of the gap between the shaft door 5.2 and the story floor 8.2 are decisive. The greater the quantity of extinguishing water the greater the water pressure which lets the extinguishing water shoot into the shaft. The shape and size of the gap between the shaft door 5.2 and the story floor 8.2 have a direct influence on the distribution of the extinguishing water 14 in the elevator shaft 10. In addition the distribution of the extinguishing water 14 in the elevator shaft 10 is formed by the difference in height between the elevator cage 1 and the story 9.2 from which the extinguishing water penetrates into the shaft. The greater the spacing between a cage roof 15 and the story floor 8.2 from which the extinguishing water penetrates into the shaft 10 the more rapidly the extinguishing water 14 falls onto the elevator cage roof 15 and the further the extinguishing water 14 is sprayed from the cage roof 15. A greater spacing between the cage roof 15 and the story floor 8.2 from which the extinguishing water penetrates into the shaft 10 additionally can have the consequence that the extinguishing water can spread wider and deeper into the shaft 10 through a higher drop path.

It is apparent from FIG. 1 that the extinguishing water 14 when impinging on the cage roof 15 should not, as far as possible, be sprayed and that the extinguishing water 14 is conducted away from the cage roof 15 by way of a cage door 4 or by way of a cage back wall 29. Not only in the case of spraying onto the cage roof 15, but also in the case of running down the cage side walls 30 is there the risk that the support means 3 is wetted by the extinguishing water 14.

At least some of the principles and problems described with respect to FIG. 1 also occur with other forms of fire extinguishing installations 13 or other kinds of elevators.

Figure 2:
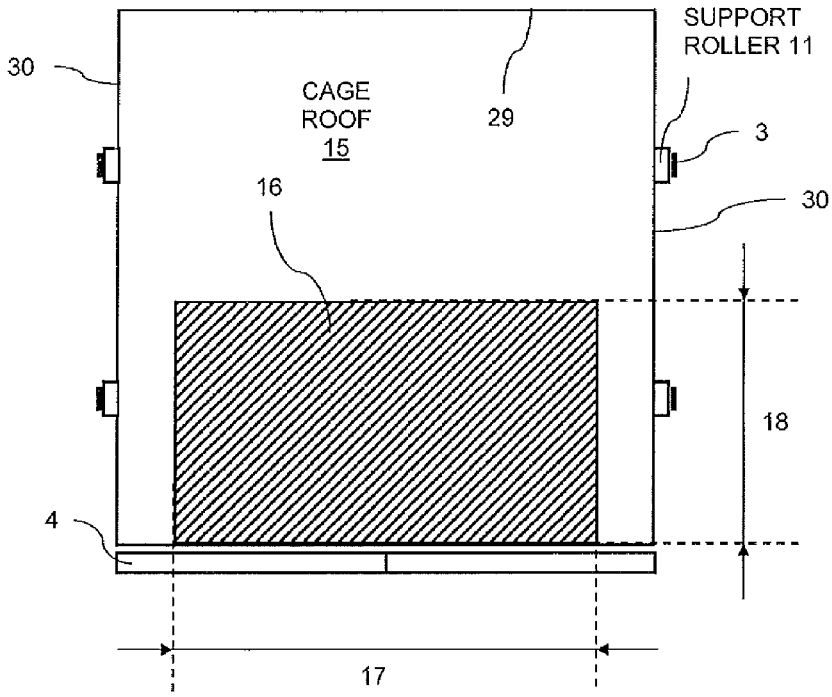
FIG. 2 shows an exemplifying form of embodiment of an elevator cage in plan view.

An exemplifying form of embodiment of an elevator cage is illustrated in FIG. 2 in plan view. The elevator cage is laterally bounded by the side walls 30, the back wall 29 and the cage door 4. In addition, the support means 3, which is led by the cage support rollers 11 around the elevator cage 1, is illustrated. A region 16 vulnerable to spray water is illustrated on the cage roof 15. This region 16 vulnerable to spray water has a width 18 and a length 17.

The path, which is explained on the basis of FIG. 1, of the extinguishing water 14 has the consequence that the region 16 vulnerable to spray water can be constructed as shown in FIG. 2. Thus, for example, the length 17 of the region 16 vulnerable to spray water is influenced at least partly by the shape and width of the gap between the shaft door 5.2 and the story floor 8.2. The width 18 of the region 16 vulnerable to spray water is also critically influenced by the shape and length of the gap between the shaft door 5.2 and the story floor 8.2. In addition, the maximum anticipated drop height of the extinguishing water 14 between the uppermost story floor 8.2 and the cage roof 15 when the cage is as illustrated in FIG. 1 located in its lowermost position has a direct influence on the shape and size of the region 16 vulnerable to spray water.

In FIG. 2 the region vulnerable to spray water is illustrated as a rectangle. It will be obvious that the region 16 vulnerable to spray water can also adopt a different shape, for example the shape of a semicircle or a trapezoid, or also an irregular shape. In addition, it is conceivable that the region 16 vulnerable to spray water is not arranged directly at an edge of the cage roof 15, but arranged at a spacing from an edge of the cage roof 15. Moreover, it is conceivable that the region 16 vulnerable to spray water covers the entire area of the cage roof 15. The width 18 of the region 16 vulnerable to spray water can be at least 1 meter and the length 17 of the region 16 vulnerable to spray water can be at least as large as a passage width of the opened cage doors 4.

Figure 3:
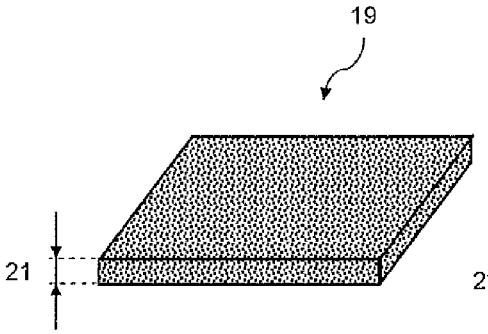
FIG. 3 shows an exemplifying form of embodiment of a spray-inhibiting element.
Figure 4:
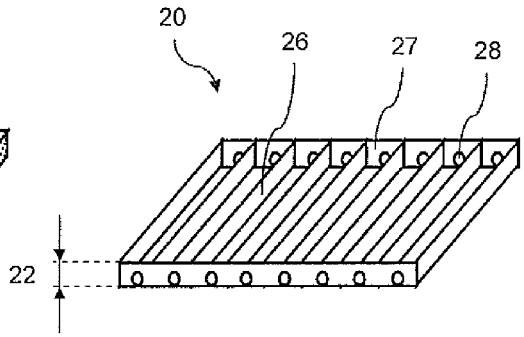
FIG. 4 shows an exemplifying form of embodiment of a spray-inhibiting element.

Two forms of embodiment of a spray-inhibiting element 19, 20 are shown by way of example in FIGS. 3 and 4. In FIG. 3 the spray-inhibiting element is constructed as porous material 19. The porous material 19 is, by way of example, a porous foam material, a spongy material or a porous stone. The porous material 19 should have a low weight as well as be fire-resistant. In addition, it can be advantageous if the porous material 19 is constructed to be tread-resistant so that walking on the cage roof is still possible without damaging the porous material 19. A thickness 21 of the porous material 19 is possibly at least 1 centimeter, but possibly at least 5 centimeters. Through a suitable thickness 21 of the porous material 19 it is possible to prevent the porous material 19 from being completely saturated with extinguishing water and as a consequence thereof loosing its spray-inhibiting property.

The porous material 19 has in the interior thereof a labyrinth of passages. These passages form pores at a surface of the porous material 19. A diameter of these pores is possibly less than 2 centimeters. In an alternative form of embodiment the diameter of the pores is less than 1 centimeter and in another embodiment the diameter is less than 0.5 centimeters.

In a further embodiment the porous material 19 has a thickness 21 of at least 1 centimeter, possibly at least 3 centimeters and possibly at least 5 centimeters.

An example of a suitable porous material 19 is a coarse-pored foam material such as is used, for example, for cleaning vehicles.

An alternative form of embodiment of the spray-inhibiting element is illustrated in FIG. 4. In this example the spray-inhibiting element is constructed as a grate-like element 20. The grate-like element 20 consists of two transverse elements 27 as well as longitudinal elements 26 arranged therebetween. A height 22 of the grate-like element 20 can be varied according to the desired spray-inhibiting properties. Generally, the greater the height 22 of the grate-like element 20, the less spray water can escape laterally. In order that the grate-like element 20 does not fill with extinguishing water and thereby lose its function of inhibiting spray water, openings 28 are provided in the transverse elements 27. In an alternative form of embodiment (not illustrated), instead of the openings 28 the transverse elements are constructed to be less high than the longitudinal elements or the transverse elements do not reach up to the support surface of the grate-like element 20.

The transverse elements 27 as well as the longitudinal elements 26 of the grate-like element 20 can be constructed from, for example, plastics material or metal. It can be advantageous if the grate-like element 20 is tread-resistant, i.e. is not damaged when walked on, as well as has a low weight. A shape of the grate-like element 20 can be adapted to the respective requirements. Thus, the grate-like element 20 can be designed to be, for example, semicircular or trapezoid-shaped.

In a further embodiment the longitudinal elements 26 are at least 3 centimeters, possibly at least 5 centimeters and possibly at least 10 centimeters, high.

Figure 5:
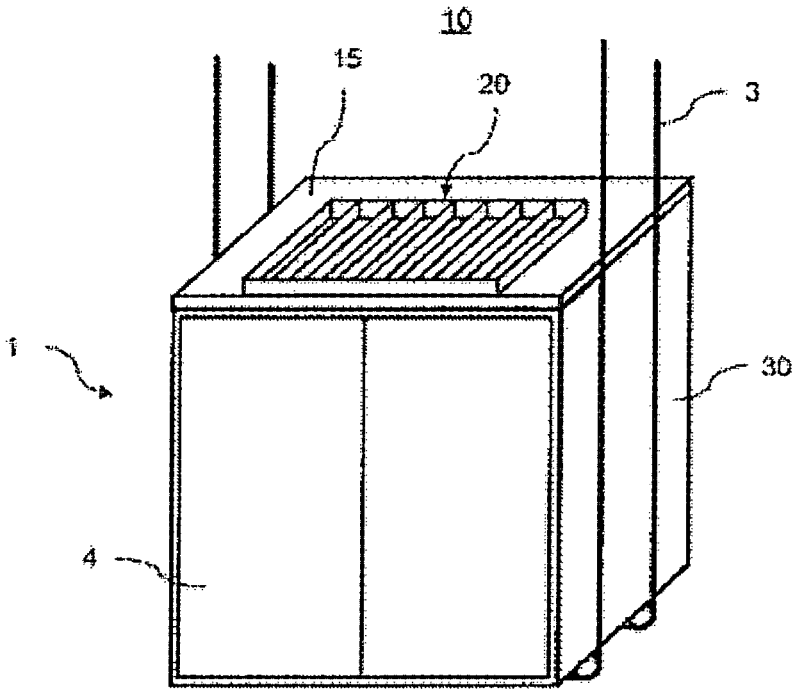
FIG. 5 shows an exemplifying illustrative form of an elevator cage with a spray-inhibiting element in perspective illustration.

An elevator cage 1 with a spray-inhibiting element 19, 20 arranged thereon is shown in perspective illustration in each of FIGS. 5 to 8. FIG. 5 shows a grate-like element 20 which is arranged on the cage roof 15. In that case the longitudinal elements 26 of the grate-like element 20 are so oriented that they are arranged substantially perpendicularly to a plane of the cage doors 4. In at least some cases, a maximum spray-inhibiting effect in the direction of the support means 3 can be achieved by such an arrangement of the grate-like element 20.

Figure 6:
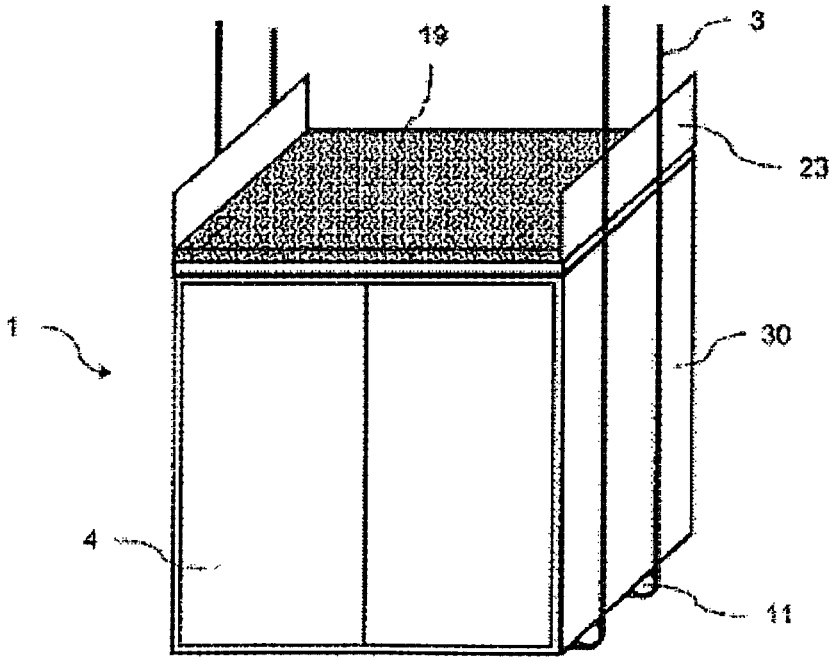
FIG. 6 shows an exemplifying illustrative form of an elevator cage with a spray-inhibiting element in perspective illustration.

An elevator cage 1 with a porous material 19 arranged thereon is illustrated in FIG. 6. In this example the porous material 19 covers the entire area of the cage roof. As an additional protective measure in this exemplifying embodiment spray protection walls 23 are arranged in a prolongation of the side walls 30. In that case the spray walls 23 protrude beyond the porous material 19. Apart from their additional protective effect against the support means 3 becoming wet with extinguishing water the spray protection walls 23 conduct the extinguishing water, which escapes from the porous material 19, away from the cage side walls 30 so that the extinguishing water is led away via the cage doors 4 as well as via the cage back wall. The height of the spray protection walls 23 can again be adapted to the respective requirements such as, for example, the maximum drop height of the extinguishing water within the elevator shaft.

Figure 7:
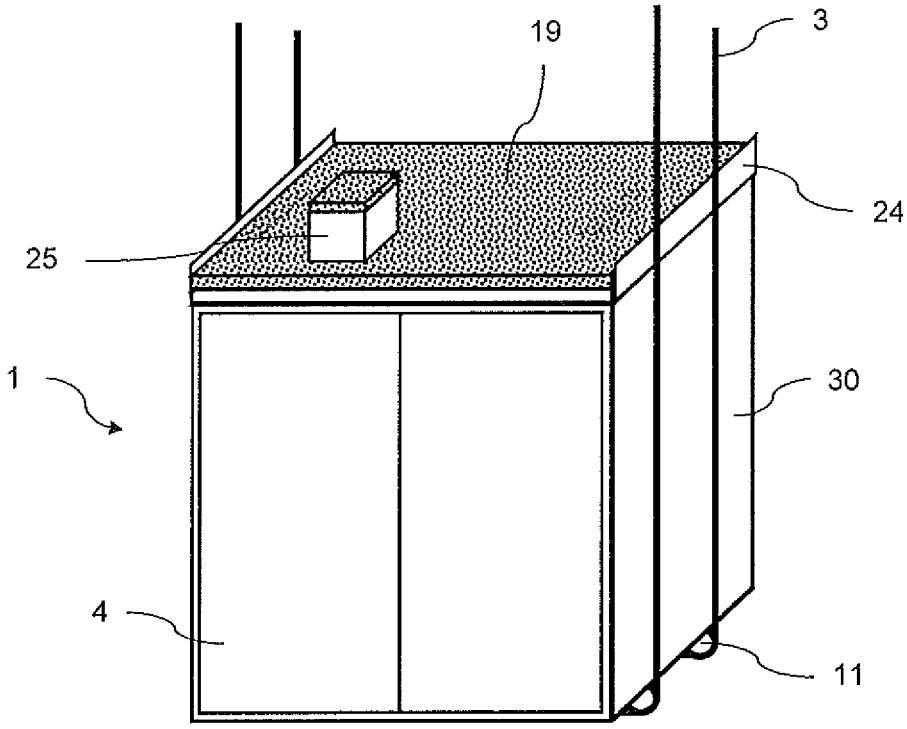
FIG. 7 shows an exemplifying form of embodiment of an elevator cage with a spray-inhibiting element in perspective illustration.

In FIG. 7 a porous material 19 is again arranged on the cage roof 15 of an elevator cage 1. In this exemplifying embodiment the elevator cage 1 has a cage top-attachment 25. This cage top-attachment 25 can contain, for example, a cage control unit. As illustrated in FIG. 7, this cage top-attachment 25 is also covered with porous material 19. The region 16 vulnerable to spray water consequently does not have to be disposed in a single plane, but can be disposed at various locations on the cage roof. In addition, in this exemplifying embodiment the cage side walls 30 are prolonged upwardly, but not with spray protection walls as in FIG. 6, instead merely with drain walls 24 which protrude only slightly beyond the porous material 19. These drain walls 24 consequently serve merely for conducting the extinguishing water away from the cage side walls 30 and not so much the additional spray-inhibiting effect.

Figure 8:
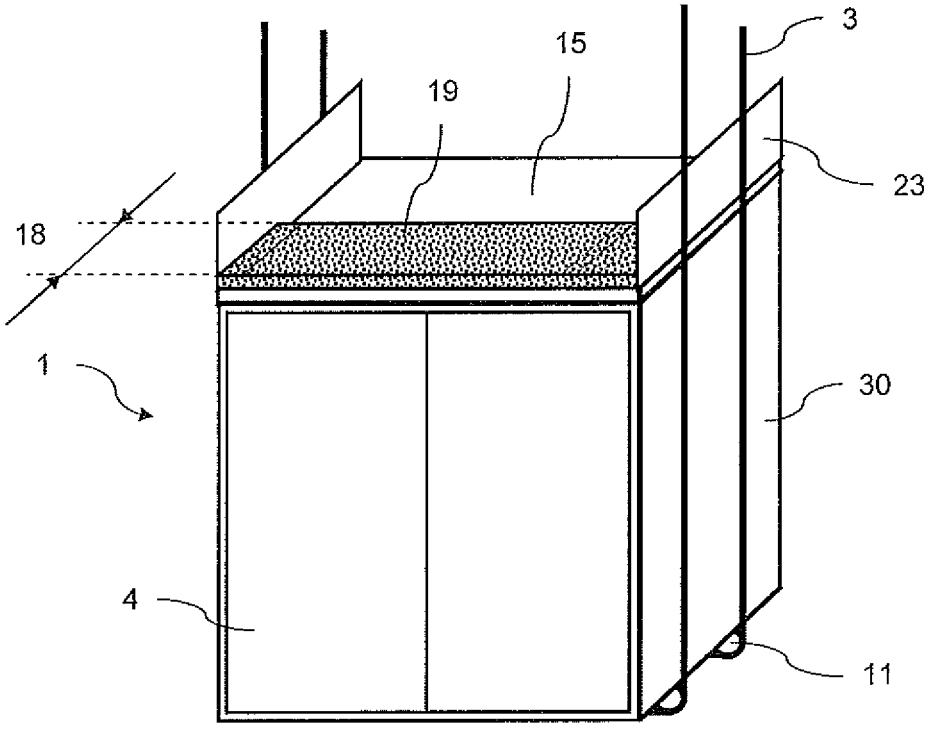
FIG. 8 shows an exemplifying illustration of an elevator cage with a spray-inhibiting element in perspective illustration.

An elevator cage having a region which is vulnerable to spray water and which does not cover the entire cage roof 15 is shown in FIG. 8. Consequently, the porous material 19 extends only as far as the width 18 of the region vulnerable to spray protection. Spray protection walls 23 are again arranged, but are guided along the entire edge length of the elevator cage roof 15.

As shown in FIGS. 5 to 8, the design of the spray-inhibiting element 19, 20 as well as additional measures such as, for example, spray protection walls 23 can be tailored to the respective requirements. This capability of adaptation of the spray protection system according to various embodiments can have the advantage that almost any kind of elevator can be retrofitted with this system.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. Fire service elevator comprising:

an elevator cage with a cage roof, the cage roof having an exterior surface, the elevator cage being at least partly supported and driven by at least one support in an elevator shaft, the elevator cage having on the cage roof a first region external to the elevator cage facing upward and exposed to the elevator shaft above the elevator cage and a second region external to the elevator cage and facing upward;

a spray-inhibiting element covering the second region of the cage roof and positioned to be substantially parallel to the cage roof such that a major surface of the element is in direct contact with the exterior surface of the cage roof, the spray-inhibiting element having a surface structure that substantially allows extinguishing water in the shaft falling on the spray-inhibiting element in event of a fire to penetrate at least partly into the spray-inhibiting element and prevent the extinguishing water from spraying toward the at least one support.

2. Fire service elevator according to claim 1, the element being constructed as porous material.

3. Fire service elevator according to claim 2, the porous material having a plurality of pores of a diameter of less than 2 centimeters.

4. Fire service elevator according to claim 2, the porous material having a plurality of pores of a diameter of less than 1 centimeter.

5. Fire service elevator according to claim 2, the porous material having a plurality of pores of a diameter of less than 0.5 centimeters.

6. Fire service elevator according to claim 2, the porous material containing a porous foam material.

7. Fire service elevator according to claim 2, the porous material being fire resistant.

8. Fire service elevator according to claim 2, the porous material having a thickness of at least 1 centimeter.

9. Fire service elevator according to claim 1, the element being constructed as a grate-like element.

10. Fire service elevator according to claim 9, the grate-like element comprising longitudinal elements so arranged that they are disposed substantially perpendicular to a plane of cage doors.

11. Fire service elevator according to claim 10, the longitudinal elements being at least 3 centimeters high.

12. Fire service elevator according to claim 10, transverse elements being so connected with the longitudinal elements that the transverse elements are arranged substantially perpendicularly to the longitudinal elements.

13. Fire service elevator according to claim 12, the transverse elements comprising openings.

14. Fire service elevator according to claim 1, the region external to the elevator cage being vulnerable to spray having a length and a width and being disposed at a side edge of the cage roof arranged closest to cage doors of the cage.

15. Fire service elevator according to claim 14, the width of the region vulnerable to spray water being at least 1 meter and the length of the region vulnerable to spray water being at least as large as a passage width of the cage doors when opened.

16. Fire service elevator according to claim 1, the element being arranged on a watertight surface so that the extinguishing water can flow from the element over the watertight surface to edges of the cage roof and from there to cage walls or to cage doors.

17. Fire service elevator according to claim 1, further comprising walls protruding beyond the element, the walls being arranged in prolongations of cage side walls.

18. An elevator cage having a cage door side, opposing side walls and a back wall, comprising:

a cage roof having an upwardly facing region exposed to an elevator shaft above the elevator cage when the elevator cage is in the elevator shaft, the cage roof region extending from the cage door side to the back wall and from one side wall to an opposing side wall: and a spray-inhibiting element extending from the car door side and covering a portion of the cage roof region less than the cage roof region and external to the elevator cage for preventing extinguishing water in the elevator shaft from spraying from the element toward a support of the elevator cage;

wherein the spray-inhibiting element is positioned to be parallel to the cage roof and wherein the spray-inhibiting element has a surface structure that allows extinguishing water falling on the spray-inhibiting element to penetrate at least partly into the spray-inhibiting element.

19. The elevator cage of claim 18, the spray-inhibiting element comprising at least one porous material.

20. The elevator cage of claim 18, the spray-inhibiting element comprising a grate.

* * * * *